US008590192B2

(12) United States Patent
Padgett et al.

(10) Patent No.: US 8,590,192 B2
(45) Date of Patent: Nov. 26, 2013

(54) WRISTBANDS WITH INTERCHANGEABLE LAYERS ALLOWING SIZING BY END USER

(75) Inventors: John M. Padgett, Clermont, FL (US); Michael G. Jungen, Orlando, FL (US); John David Worrall, Clermont, FL (US); Maximillian Philip Burton, San Francisco, CA (US); Carson Lau, San Francisco, CA (US); Adam D. Leonards, El Cerrito, CA (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

(21) Appl. No.: 13/603,512

(22) Filed: Sep. 5, 2012

(65) Prior Publication Data

US 2012/0324773 A1 Dec. 27, 2012

Related U.S. Application Data

(63) Continuation of application No. 12/714,861, filed on Mar. 1, 2010, now Pat. No. 8,276,298.

(51) Int. Cl.
*A44C 5/00* (2006.01)

(52) U.S. Cl.
USPC ..... 40/633; 283/75; 63/3.2

(58) Field of Classification Search
USPC ..... 40/633, 665; 283/75; 63/6, 5.1, 3.1, 3.2, 63/21; 24/3.2, 265 WS, 16 PB
See application file for complete search history.

(56) References Cited

U.S. PATENT DOCUMENTS

| | | | | | |
|---|---|---|---|---|---|
| 2,219,277 | A * | 10/1940 | Kaufmann | 63/21 |
| 4,837,960 | A * | 6/1989 | Skaja | 40/636 |
| 5,746,501 | A * | 5/1998 | Chien | 362/103 |
| 7,845,191 | B2 * | 12/2010 | Czajka et al. | 63/15.6 |
| 8,250,796 | B2 * | 8/2012 | Padgett et al. | 40/633 |
| 2005/0046175 | A1 * | 3/2005 | Fox | 283/75 |
| 2005/0108912 | A1 * | 5/2005 | Bekker | 40/633 |
| 2009/0056373 | A1 * | 3/2009 | Czajka et al. | 63/3 |
| 2011/0209373 | A1 * | 9/2011 | Padgett et al. | 40/633 |

* cited by examiner

*Primary Examiner* — Kristina Junge
(74) *Attorney, Agent, or Firm* — Disney Enterprises, Inc.; Kent A. Lembke

(57) ABSTRACT

A wearable band with an adjustable size or length. The band includes a first band element and a second band element with a planar body extending from a first to a second end. The second band element body is greater in length than the first band element body and includes a hole for receiving the first band element body. The band includes a coupling mechanism that detachably connects an outer sidewall of the first band element body to the inner sidewall of the second band element body, e.g., to allow the two band elements to be selectively disconnected and reassembled without tools. The coupling mechanism includes a first coupling component extending along the outer sidewall of the first band element and a second coupling element extending along the inner sidewall of the second band element such that the two band elements are connected along the periphery of the hole.

17 Claims, 7 Drawing Sheets

WRISTBANDS WITH INTERCHANGEABLE LAYERS ALLOWING SIZING BY END USER

REFERENCE TO RELATED APPLICATIONS

This application is a continuation of U.S. patent application Ser. No. 12/714,861, which was filed on Mar. 1, 2010, entitled "WRISTBANDS WITH INTERCHANGEABLE LAYERS ALLOWING SIZING BY END USER" which is hereby incorporated by reference in its entirety.

BACKGROUND

1. Field of the Description

The present description relates, in general, to wearable bands such as wristbands that are adjustable in size, and, more particularly, to wearable band assemblies that include a multi-sizing mechanism that allows the band, such as a wristband with identification technology, to be sized in a tool-less manner by a user or wearer through the use of interlocking layers or band elements that can be combined to define the size (or length) of a band.

2. Relevant Background

Bands such as wristbands are worn in numerous settings. For example, watches have typically been worn on a wrist through the use of a wristband. In hospitals, patients often are provided an identification bracelet, strap, or band that they wear on their wrist. An amusement or theme park may provide a visitor or guest with a wristband that includes identification information or technology (e.g., a readable bar code, a radio frequency identification (RFID) transceiver, or the like) that identifies the visitor and allows the visitor to access the park's facilities. Often, bands are worn as fashion accessories or to allow the wearer to make a statement (e.g., to support a cause such as medical research, a political candidate, a sports team, or the like). It is likely that the demand for wearable bands such as wristbands will continue to grow in the coming years.

One ongoing challenge for the makers of wristbands and other wearable bands is providing proper sizing for the end users. For example, most multi-size wristwatches include a first band portion that is attached at a first end to the timepiece and at a second end may have a number of spaced apart holes. A second band portion is attached at its first end to the timepiece and at its second end may contain a buckle-style clasp mechanism for mating with the holes of the first band portion. A person uses the clasp mechanism to both size the band about their wrist and to also lock the timepiece to their wrist. The wristwatches are multi-size in that the spaced apart holes allow the same wristwatch to be worn by a set of people whose wrists have a size that falls within a predefined range (e.g., a minimum and maximum sized wrist diameter defined by the first and last hole on the band). However, people outside this predefined range would not be able to wear the wristwatch, and the wristwatch manufacturer either simply loses these sales or may provide additional wristwatches that have different size ranges to suit these other buyers. Unfortunately, this requires added inventory that may or may not be sold. Some efforts have been made to provide band designs that allow the band to be sized for a particular person, but these designs typically require specialized tools to adjust the band and are expensive to manufacture. In other cases, a band selected for a user to match their wrist size may be attached to the timepiece, but, again, this typically requires a special tool for attachment of the band to the timepiece and may require the buyer to have the watch sized by a trained technician.

As another example of the use of wearable bands, RFID wristbands are commonly used in hospitals and entertainment venues to identify individual patients and guests. The wristband may include or provide a link to a variety of information such as the person's name, their room number, a seating location for a show, entitlements permitted in the hospital or venue, and so on. The wristband is often designed to be secured or locked onto the wrist of the person during their stay at the hospital or participation in an entertainment event.

While these wristbands have been useful in identifying the patients and guests, their design has typically not effectively accommodated the wide range of users' wrists, which has resulted in many users having very loose or too tight and uncomfortable fitting wristbands. Additionally, many wristband designs use either an adhesive closure that is peeled away from the wristband or a separate, one-time plastic snap closure. The adhesive closures sometimes do not provide the closing strength desired and once removed, cannot be worn again. The plastic snap closures provide greater closing strength but often are intentionally designed for one time use, which limits use of these bands on an ongoing or repeated basis. Further, the snap closures often do not support a large enough range of wrist sizes such that they are often too tight or cannot be worn comfortably or are too loose which may allow them to fall off.

Accordingly, there remains a need for a low cost, multi-sizing mechanism for RFID wristbands and other wearable bands or straps. The band designs preferably would have durable opening and closing features to allow reuse of the band and would support relatively inexpensive manufacture from a variety of available materials such as plastics, silicones, metals, leathers, cloths, and/or other materials used presently (and in the future) for wearable bands. Further, there is a need for such a multi-sizing mechanism to be more fully adjustable to the wearer's wrist size, to provide a secure fastening mechanism that during regular wear can be fastened and unfastened by the wearer with ease, and to provide an aesthetic appearance that accommodates different wrist sizes within a large audience or wearer demographic.

SUMMARY

To address the above and other problems with wearable bands such as identification bands, a wearable band design is provided that allows a wearer to easily adjust the size of the band to suit the size of their wrist (or other body part such as the ankle or neck). Generally, a band assembly is provided that includes a first or inner layer/band element which may take the form of a thin or planar body (which may generally be rectangular with rounded ends). This inner band element may include the intelligence of the band assembly in that it may include an identification member such as an RFID tag, bar code, or the like. The band assembly further includes a second band element with a planar body having a length that exceeds the first band element body's length and includes a central hole defined by an inner sidewall. When the inner band element is received in this hole its outer sidewall is coupled to the inner sidewall of the second band element (e.g., these two mating/abutting sidewalls provide a coupling or interconnecting mechanism with their configuration such as to provide a tongue and groove arrangement or a zipper/snap type arrangement). Typically, the coupling mechanism is designed for detachable coupling/connection so as to allow the second band element to be removed and then later reattached (or replaced by a different band element that allows personalization/customization of the band assembly).

The band assembly may further include a third band element with a planar body having a hole for receiving the second band element body so as to further lengthen the band assembly, and these two band elements or layers are likewise joined at their mating sidewalls. A series of holes may be provided along the end portions of each of the band elements along with a clasp device to allow the band assembly to be attached to a wearer and to provide an amount of size adjustment. Larger size adjustments are made by removing a layer or outer band element such as by removing the third layer or band element from the second layer or band element or by removing the second layer or band element from the first or inner band element.

More particularly, a wearable band is provided (such as a wristband or the like) with an adjustable size or length. The band includes a first band element (or layer) with a body extending from a first to a second end and with an outer shape defined by an outer sidewall. The band further includes a second band element with a body extending from a first to a second end. The second band element body has a length that is greater than the length of the first band element body and includes a hole for receiving the first band element body (e.g., the second band element body extends about or surrounds in a concentric ring the first band element body). The band also includes a coupling mechanism that detachably connects the outer sidewall of the first band element body to the inner sidewall of the second band element body (e.g., to allow the two band elements to be selectively disconnected and reassembled without tools).

The bodies of the two band elements may be generally planar (e.g., elongated rectangles with rounded ends or other shapes), and the coupling mechanism may include a first coupling component extending along the outer sidewall of the first band element and a second coupling element extending along the inner sidewall of the second band element such that the two band elements are connected along the entire periphery of the hole (or their abutting sidewalls). For example, the coupling mechanism may take the form of a tongue and groove arrangement with the tongue provided on either sidewall and the groove or recessed surface for receiving this tongue provided on the other sidewall. In such cases, the body near the tongue/post may be greater in hardness than that of the groove so as to enhance the coupling of the two bodies together (and this locking may be furthered by providing friction ridges on the post and/or groove sidewalls).

In another example, the coupling mechanism may include a vertical wall element spaced apart from the outer sidewall of the first band element body (e.g., an L-shaped extension to provide a coupling component) so as to define a groove. The coupling mechanism may also include a vertical post element spaced apart but attached to the inner sidewall of the second band element body, with the groove having a cross sectional shape for receiving a tip or head on the end of the vertical post element (e.g., the coupling mechanism may provide a zipper-like coupling). In other embodiments, a third band element is provided with an elongate body having a hole for receiving the second band element body and to detachably couple with the outer sidewall of this received second band element body (e.g., further lengthen the band by adding an additional outer concentric ring). The first or inner band element may include a user identification member such as an RFID tag.

DETAILED DESCRIPTION OF THE PREFERRED EMBODIMENTS

The following description is generally directed toward a wearable band such as a wristband that may be readily configured to one of two or more sizes by adding or removing band layers or band sizing elements (or simply "band elements"). FIGS. 1-9 illustrate several embodiments of such a wearable band, but, prior to describing these band embodiments, it may be useful to more generally describe exemplary wearable bands (which may also be called wristbands herein without being limited to use on a wrist) and advantages of such bands when compared with existing bands or straps. Additionally, the following description highlights use of the bands as an RFID wristband, but it will be understood based on the description that the bands can be used with nearly any identification technology (such as barcodes or the like) as well as for bands without identification technologies/readable information. For example, the bands may be used with timepieces/watches or as products worn for fashion or other reasons.

Generally, the wearable bands described herein are designed to address or solve the multi-sizing and fastening mechanism problem that faces makers of wrist and other bands. The bands are easy for end users to assemble or configure into a particular size and allow interchanging of band layers/elements to personalize the bands. The bands are also adapted to make manufacture relatively inexpensive as one base design provides a multi-size band that can be used by all or a large portion of the population, and the supply chain is also simplified in this manner as one or several base designs may be offered to the consumers, who can optionally personalize their bands by purchasing personalized/customized portions of the band.

In one example, an adjustable RFID wristband is provided that can be manufactured from a variety of modern day materials including plastics, rubbers, and silicones and even, in some cases, metals, leathers, cloths/textiles, and other materials. The wristband is fully adjustable by the wearer to suit their wrist size and also provides an aesthetic appearance. The wristband is also adapted to provide a secure wristband fastening mechanism that during regular wear can be fastened and unfastened by the wearer with exceptional ease (e.g., the band supports reuse rather than being a one-time product as was the case with many prior one-size-fits-all straps). This embodiment may be thought of as providing a band assembly made up of three "wearable" layers/band elements (see FIGS. 1 and 4) with each layer or element allowing the band assembly to cover or be used with a defined wristband size range or wrist size range (see FIGS. 2 and 3).

Figure 5:
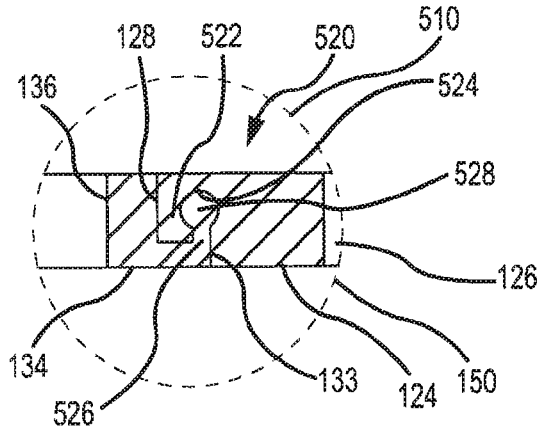
FIG. 5 is an enlarged view of the interlocking or coupling mechanism provided at the junction of an outer edge and an inner edge of two of the band layers or elements, which allows ready removal or peeling away of a layer/element and/or connection of new or interchanged layer/element (e.g., to increase the size of a band, to personalize/modify the look of the band with a new layer/element, or the like)
Figure 8:
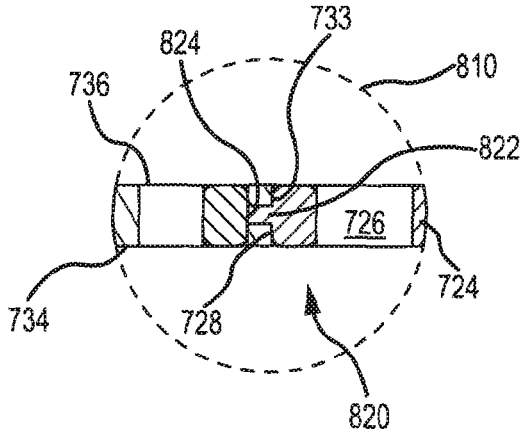
FIG. 8 is an exploded view of the band assembly of FIG. 7 showing in more detail the interconnecting/coupling mechanism provided by the configuration of the edges/sidewalls of the band layers/elements.

Each of the band layers/elements may have one or more edges/sidewalls that are designed to provide an interlocking/coupling mechanism that allows the layers/elements to be locked together and to be separated by the user to size the band assembly. For example, as shown in FIG. 5, the interlocking/coupling mechanism may take the form of a zipper/snap mechanism similar to those found in the end of resealable food storage bags or the like or, as shown in FIG. 8, the interlocking/coupling mechanism may take the form of a peel away mechanism (e.g., a horizontally orientated tongue and groove arrangement similar to that found in some liquid beverage container caps with a removable security/sanitary band).

In use, the wristband assembly may initially be shipped or provided with all layers/elements assembled or coupled together such that the wristband is at its largest size or longest length (e.g., sized to fit a range of larger wrist sizes). The end users may then zipper/snap on or peel away layers or band elements (e.g., concentric rings of band material used to lengthen the band) to reveal or resize the wristband so that it fits their specific wrist size (e.g., wear "as is", remove only the outer layer/concentric band element, remove the two outer layers/concentric band elements, and so on). In some cases, the removed layers may be replaced by other bands, too, so as to allow the end user to personalize/customize their band as well as to size it to their wrists or to allow the wristband to be used on more than one wrist size (e.g., not permanently sized upon removal/peeling away a layer or band element).

Prior to the band designs presented herein, many wristbands used either an adhesive closure that is peeled away from the wristband or a separate, one-time plastic snap closure. The adhesive closures sometimes did not provide a desired closing strength and once removed could not be worn again. The plastic snaps provided a greater closing strength but were also often designed for one-time use, did not fit the wearer comfortably, and/or were too loose.

With regard to other band applications, a typical wristwatch incorporates a buckle-style watch clasp. Similar to shoe manufacturing, most wristwatches are designed to a particular style with that same style or product run having a variety of wristwatch bands in different sizes to accommodate the specific end users' wrist sizes. However, similar to shoe shopping, when an end user purchases a wristwatch they try on different sizes of wristwatches (or wristwatch bands) of the same style to determine which band fits them appropriately. Because of the variability of different end user wrist sizes, the watch retailer must keep a large inventory of different wristband sizes to accommodate their customers, which significantly increases inventory costs for the retailer that may be acceptable in some settings (such as for higher end band products such as certain wristwatches). However, in many fashion and wearer ID settings (such as entertainment venues and the like), it is much more desirable to be able to provide a one-size-fits-all solution or band design that can be sized by the seller or the wearer to suit their wrist size rather than carrying numerous versions/sizes of the band. The described wearable bands provide a "one size fits all" design that provides three wearable and user-selectable/interchangeable band layers/elements, which allows a venue operator or provider of bands to maintain one common wristband inventory that accommodates a wide range of wrist sizes (e.g., address the multi-sizing problem associate with serving large audience/customer bases).

Figure 1:
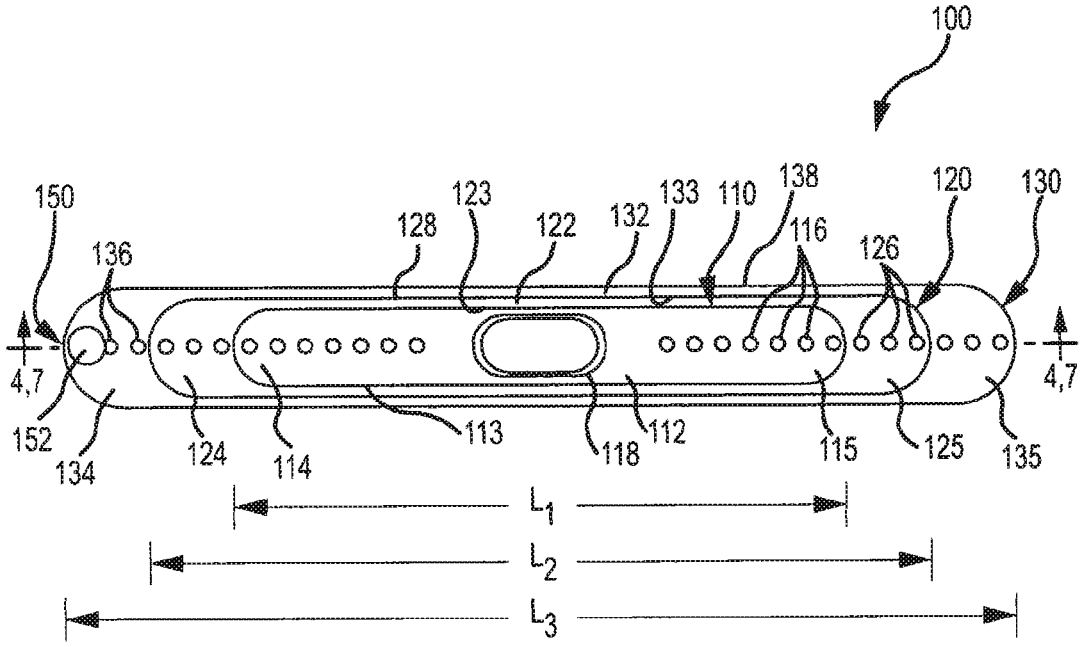
FIG. 1 is a top view of a wearable band assembly of an embodiment of this description as may be delivered to a purchaser or wearer (e.g., assembled to have a maximum or largest length such as to suit a maximum sized wrist or to suit a group or range of larger wrist sizes)
Figure 3:
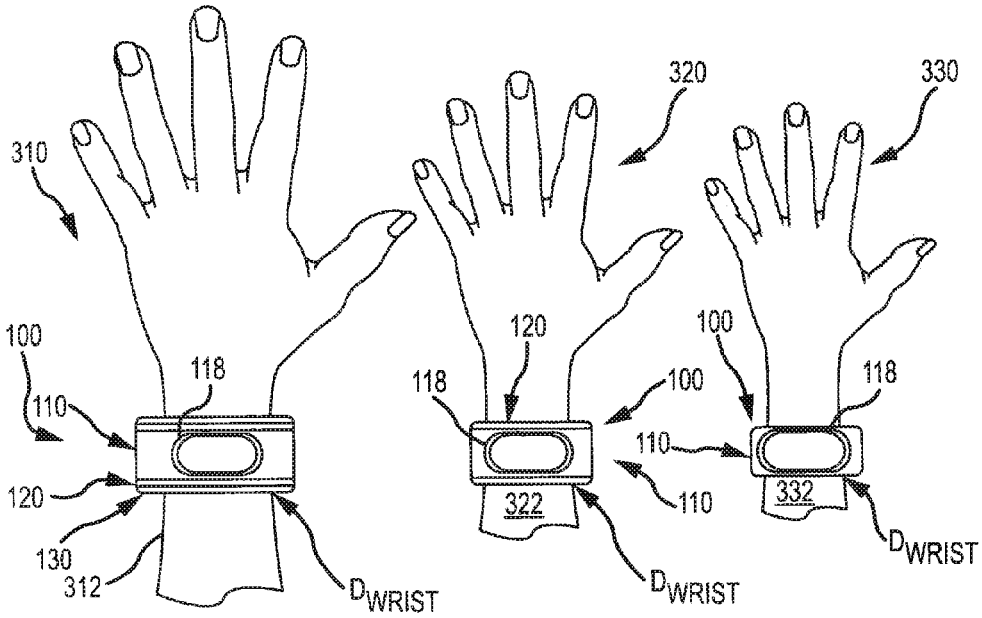
FIG. 3 illustrates three users or wearers wearing three of the band assemblies shown in FIG. 1 with three, two, and one of the band layers or band elements included so as to size the wrist assembly to three different sizes of wrists associated with users/wearers (e.g., including more layers/element increases the size of the band while peeling away or removing layers/elements reduces the size of the band)

FIG. 1 illustrates one embodiment of a wearable band assembly 100 that may be used to provide a single band product that can be worn or used by people (i.e., wearers or users) with wrist sizes that fall within one of three predefined size groups. The band assembly 100 includes a set of three layers or band elements 110, 120, 130 and a clasp 150 for fastening the interconnected band elements/layers 110, 120, 130 to a wearer's wrist (as shown in FIG. 3). The wearer may simply peel away or remove layers 120 and 130 or layer 130 to size the band assembly 100 to fit their wrist.

The first or inner layer or band element 110 may be thought of as the base or minimal layer as this layer/element 110 is included in each configuration of the band assembly 110. The inner band element 110 has a body 112 that extends from a first end 114 to a second end 115 with a first length, $L_1$, which is the minimum size of the band assembly 100. The shape of the body 112 is defined by an outer edge or sidewall 113 that extends about the periphery of the body 112, and, as shown, the body may be rectangular with rounded or circular ends 114, 115. The outer edge 113 of the body 112 also includes a portion of a coupling or interconnecting mechanism (such as shown in FIG. 5 or 8 or other configuration useful for connecting to layers of the assembly 100) used to connect or lock it to adjacent layer/element 120. The body 112 also includes a number of holes 116 extending through its thickness at each end 114, 115 such that the clasp 150 may be inserted into or mounted on a hole 116 in one end 114 or 115 and then the clasp 150 may be extended through a hole 116 in the opposite end 114 or 115 to securely close the band assembly 100 upon a wrist when the band assembly 100 is configured/sized to only include the layer/element 110. The layer or band element 110 also may include an identification technology portion 118 when the band assembly 100 is adapted for identifying the wearer such as by the inclusion of an RFID transceiver or RFID element embedded within the ID technology portion 118 of the body 112.

The band assembly 100 also includes a second or middle (or intermediate) layer or band element 120 that can be selectively coupled to the edge 113 of the inner layer 110 as part of sizing or personalizing the band assembly 100. The middle layer 120 has a body 122 that extends from a first end 124 to a second end 125 with a second length, $L_2$, that is greater than the length, $L_1$, of the inner layer 110, which allows the body 122 to extend about the periphery of the inner layer 110 and allows the combined layers 110, 120 to provide a longer configuration of the band assembly 100 (which allows it to be worn by a second group of wearers with larger wrists than those associated with wearers of the assembly 100 with only the inner layer 110).

The body 122 may again be generally rectangular in its outer shape with rounded ends 124, 125 as defined by an outer edge or sidewall 128. Also, like the inner layer 110, the body 122 of the middle layer 120 may include a number of holes 126 in each end 124, 125 such that the clasp 150 (with a clasp head 152 or portion larger than the holes 126 being shown in FIG. 1 that prevents it from passing through the holes 126) may be mounted on the layer 120 when the assembly 100 only includes layers 110, 120. As shown, the holes 126 are arranged along a line such as a center longitudinal axis of the body 122 and this aligns the holes 126 in each end 124, 125 (and with the holes 116 of body 112 which are also arranged in a linear manner). To allow the inner layer 110 to be mated with the middle layer 120, the body 122 of the middle layer 120 includes a central hole defined by an inner edge or sidewall 123. The hole defined by the inner edge 123 generally has a shape and dimensions that match the dimensions and shape of the body 112 as defined by its outer edge/sidewall 113 (e.g., the hole has a length, $L_1$, and is generally rectangular with rounded ends to receive ends 114, 115). The sidewalls/edges 123, 128 are configured to couple with the outer sidewall 113 of the inner layer 110 and with the inner sidewall 133 of the outer layer 130, respectively, such as by providing coupling or interlocking mechanism as shown in FIG. 5 or FIG. 8 or the like.

The band assembly 100 further includes a third or outer layer or band element 130 that can be selectively coupled to the outer edge 128 of the middle layer 120 as part of sizing or personalizing the band assembly 100. The outer layer 130 has a body 132 that may be similar in configuration as the middle layer 120 in that the body 130 extends from a first end 134 to a second end 135 with a third length, $L_3$, in that each end 134, 135 includes a number or set of holes 136 for receiving the clasp 150 for mounting and closure of the band 100, and in that the body 130 includes a central hole or gap defined by an inner sidewall or edge 133 so as to be able to receive and couple with the outer sidewall 128 of the middle layer 120. The length, $L_3$, of the outer layer 130 is longer than the length, $L_2$, of the middle layer 120 such that when the band assembly 100 includes all layers 110, 120, and 130 the band assembly 100 has a larger band size that allows it to be worn or used by a group of wearers with larger wrists falling within a third wrist size range. The body 132 may have an outer shape similar to that of the inner and middle layers 110, 120, e.g., an elongate rectangle with rounded ends 134, 135 as defined by outer sidewall or edge 138. The hole or gap defined by the inner sidewall or edge 133 has a shape and dimensions (e.g., a length equal to $L_2$) that match the body 122 of the middle layer 120 such that middle layer 120 may be received in this hole or gap, and the inner sidewall 133 is configured to couple or interconnect with the outer sidewall 128 of the body 122 (e.g., to provide a coupling/interconnecting mechanism as shown in FIG. 5 or FIG. 8 or the like).

The bodies 112, 122, 132 may be formed of the same or differing materials, and these materials may vary to implement the assembly 100. In some embodiments, the bodies 112, 122, 132 are formed of a plastic, a rubber (e.g., a silicone or the like), or similar material that may be relatively rigid but still be comfortable to wear and also be flexible to facilitate coupling of the layers 110, 120, 130 at their paired/mated edges 113/123 and 128/133. The number of holes 116, 126, 136 may also be varied widely to practice the assembly 100 as well as the spacing between adjacent ones of the holes 116, 126, 136. Generally, one to three or more holes will be provided on each end 114, 115, 124, 125, 134, 135 such that the clasp 150 may be mounted and to allow connection of the two ends of a particular body 112, 122, 132 and to allow the band assembly 100 to be sized for a range of wrist sizes in each of its three configurations (i.e., band element 110 provides a range of sizes, the combination of band elements 110 and 120 provides a range of sizes, and the combination of band elements 110, 120, and 130 provides a range of band sizes via the inclusion of the holes rather than a single size with each configuration). Note, the band assembly 100 is shown to include three layers 110, 120, 130 but the assembly may include only two layers 110 and 120 to practice the assembly 100 or it may include four or more layers (e.g., layers 110, 120, 130 plus additional layers) so as to support a fewer or greater number of wrist size ranges (rather than the three shown in FIG. 1).

Figure 2:
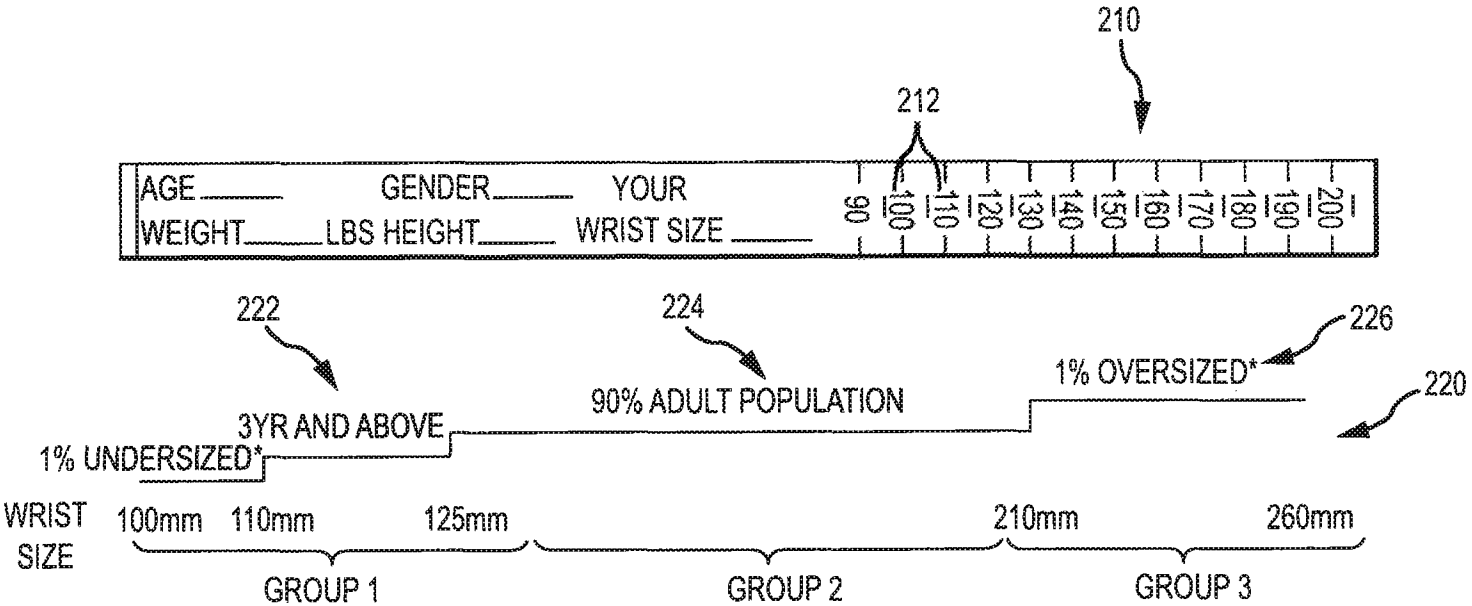
FIG. 2 illustrates a tape measure or tool that may be used by a purchaser/wearer of a band assembly to size their wrist and further illustrates a graph showing grouping of wrist sizes or ranges of wrist sizes to correspond to lengths/sizes of a wrist assembly (such as the assembly of FIG. 1) via inclusion or exclusion of a number of band layers or band sizing elements (or simply "band elements")

FIG. 2 illustrates a tape measure 210 that may be used by a wearer to determine or measure their wrist size. The tape measure 210 includes markings 212 that indicate the measured size when the tape measure 210 is wrapped about the wrist and aligned with the end of the tape measure 210. As shown, the smallest wrist size is typically about 90 millimeters (mm) while the largest wrist size is over 200 mm (such as about 260 mm or more). In one embodiment, the band assembly 100 may be provided or shipped with the tape measure 210, and the user/wearer may use the tape measure to determine their wrist size. This wrist size may then be used to determine whether to remove any of the interchangeable layers 120, 130 and if so, whether to remove one or both of the layers to properly size their wrist band assembly 100.

In this regard, graph 220 illustrates exemplary groups 222, 224, 226 that may be provided for a band assembly 100 for a typical human population. In this example, the band assembly 100 is a wristband and graph 220 represents differing wrist sizes for which it is desirable to provide a multi-sizing band assembly 100. As shown, a first group 222 that typically includes children and adults with smaller wrists is shown (e.g., wrists of about 100 to 130 mm or the like), and, in the band assembly 100, the first or inner layer 110 may be provided with a length, $L_1$, and holes 116 to allow it to be worn by people with wrists falling into the first group 222 (e.g., less than about 130 mm in "diameter").

A second group 224 may be defined or selected to include a range of "average" teens and adults. For example, the second group 224 may range from about 130 mm (or some number smaller to provide overlap with group 222 such as 125 mm) to about 190 mm or the like, and the middle or intermediary layer 120 may have a length, $L_2$, that is chosen in combination with its arrangement of holes 126 to allow the band assembly 100 with coupled layers 110, 120 to be worn by individuals having a wrist size between 130 and 190 mm (or other lower and upper bounds). Finally, in this example, a third group 226 may be defined to include people with larger wrists such as wrists of 190 mm to 240 mm (or some other lower and upper bounds with the lower bound often being chosen to provide an overlap of the second and third groups 224, 226 such as 185 mm when the second group upper bound is 190 mm). The outer band layer 130 may then be chosen to have a length, $L_3$, and arrangement of holes 136 such that people with wrist sizes falling in the third group 226 would be able to wear the band assembly 100 when it included (as shown in FIG. 1) all three layers 110, 120, and 130 coupled together at their adjacent/abutting edges or sidewalls.

FIG. 3 illustrates the use of the band assembly 100 in three different configurations 310, 320, 330 to provide a band with three differing lengths (i.e., lengths $L_3$, $L_2$, and $L_1$, respectively). In configuration 310, the band assembly 100 is configured as shown in FIG. 1 to include all three layers or band elements 110, 120, 130 coupled together (or prior to peeling away element 130 or element 120). In this configuration, the band assembly 100 has the length, $L_3$, and it can be fastened using the clasp 150 to be worn on a wrist 312 with a diameter, $D_{Wrist}$, that falls within a range of larger wrist sizes (e.g., group 226 of FIG. 2 which may be wrists of about 190 mm to 260 mm or more). In this manner, the ID technology element 118 within inner band element 110 is included in the band 100 as are sizing or accessory band elements 120, 130 (e.g., in some embodiments, the band elements 120, 130 may be exchanged or interchanged by the wearer for non-standard or original elements so as to customize the look to suit the wearer).

In configuration 320, the band assembly 100 has been modified or sized to suit a smaller wrist 322 with a smaller or more "average" wrist diameter, $D_{Wrist}$, or size. To this end, the outer band element or layer 130 has been removed or peeled away from the middle or intermediary band element 120 (e.g., the coupling between the outer sidewall of the band element 120 and inner sidewall of the band element 130 has been broken or disengaged). Note, the intelligence or ID technology element 118 is still present in the assembly 100 even after the modification/sizing such that the person can be identified by wearing the assembly 100. In configuration, the band assembly 100 has been modified or sized further to suit an even smaller wrist 332 with a smaller or below average wrist size or diameter, $D_{Wrist}$. To this end, the middle or intermediary band element or layer 120 has been removed or peeled away from the inner band element 110 (e.g., the coupling between the outer sidewall of the inner band element 110 and the inner sidewall of the middle band element 120 has been broken or disconnected). Again, even in this smallest configuration 330 with only the inner layer 110 being worn, the intelligence of the band 100 or the ID technology element 118 is present on the wrist 332 to identify the wearer (e.g., when an RFID component is read by an RFID reader, a bar code is read by a bar code scanner, and so on).

Figure 4:
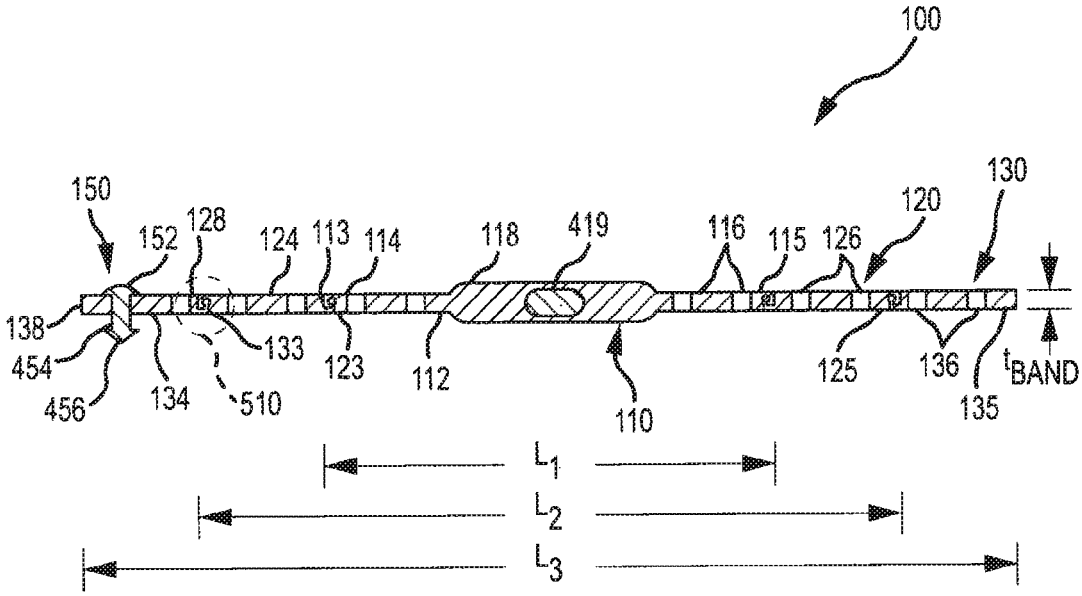
FIG. 4 is a sectional view of the band assembly of FIG. 1 taken along line 4-4.

FIG. 4 is a sectional view of the band assembly 100. As shown, the band assembly 100 is made up of a number of concentrically arranged band elements (or layers) 110, 120, 130 (e.g., an inner band element or core element is surrounded by one or more rings/band elements that expand the width and the length of the band assembly 100). Specifically, inner band element 110 is positioned at an inner or central point of the assembly 100 and is coupled to the next ring of the assembly 100 provided by middle or intermediary band element 120. Then, outer band element 130 provides a third concentric ring of assembly 100 when it is coupled with the middle band element 120. With the addition of each band element 120, 130 and, in some cases (not shown) additional band elements, the length of the band assembly is increased and so is the width of the band assembly as can be seen in FIG. 1 (as material of a surrounding band element body 122, 132 is provided about the next inner rings of the band assembly 100).

The bodies 112, 122, 132 of the band elements 110, 120, 130 may generally have a single thickness, $t_{Band}$, such that the band assembly 100 is a substantially planar and typically thin product or device (e.g., 0.0626 inches to about 0.25 inches may be a typical thickness range for a plastic or rubber band assembly 100). The ID component 118 may be thicker than the other portions of the body 112 and include a cavity or pocket that may hold an ID device 419 (e.g., an RFID chip or transceiver) while in other cases the ID component 118 may be replaced by a timepiece or a fashion/personalization component.

The clasp 150 may take many forms such as a multi-prong/poppet arrangement to engage two or more holes 116, 126, or 136 of one of the band elements 110, 120, 130 (e.g., the outer ring or band element of the current configuration of the band assembly 100). As shown, the clasp 150 has a head 152 that mates with an upper surface of an end 134 of the outer band element 130 as the shaft or post 454 of the clasp 150 is extended through a hole 136 in the body 132 of the outer band element 130. The tip or end 456 of the clasp post 454 may have a larger diameter to provide shoulders that mate with an opposite end 135 when the band assembly 100 is attached to a person's wrist or placed in a circular arrangement and closed/clasped together at its ends 134, 135. The length of the post 454 may be chosen such that the spacing between the lower surface of the body 132 (or 122 or 112 in differing configurations of assembly 100) and the shoulders of the tip 456 is at least about the band thickness, $t_{Band}$, such that the tip 456 engages the surface of the body 132 at the opposite end 135 when the post 454 is extended through another hole 136 in the body 132.

As shown in FIG. 4, each of the band elements 110, 120, 130 is coupled or interconnected with the adjacent band element(s) via a configuration of their abutting sidewalls 113, 123, 128, 133. Such interconnection may be performed or provided for in a number of ways to practice the band assembly 100 with it typically being desirable that the band elements 110, 120, 130 be securely held or locked together but that the layers/elements 120, 130 be removable. Typically, such removal can be done without tools (e.g., peel away or unzip the outer rings/band elements 120, 130). Further, many embodiments provide such interconnection in a manner that allows a removed band element 130 and/or 120 to be reattached or replaced with another band element (e.g., to personalize or customize a band assembly 100 with different band elements that may have different colors, artwork, graphical embellishments personal to the wearer, and so on).

To this end, FIGS. 4 and 5 illustrate one such coupling or interconnecting mechanism or assembly 520. The coupling mechanism 520 is shown most clearly in FIG. 5 in the enlarged view 510, and it may be considered an L-shaped bulb or post arrangement with one sidewall providing an over-mould or groove for receiving the bulb/post. As shown, the middle band element or layer 120 is coupled or joined to the outer band element or layer 130 via the coupling mechanism 520. The coupling mechanism 520 may be thought of as a zipper or snap configuration similar to that found in the ends of many plastic food storage bags. In the mechanism 520, the coupling or mating components generally provide a vertical snapping/zipping mechanism in that the interlocking components extend transverse to the plane containing the bodies 112, 122, 132 of the band elements 110, 120, 130.

Specifically, the sidewall or edge 128 of the middle band element 120 provides a vertical wall or element 522 that extends vertically away (such as "downward" in the figure) from a horizontal/outer surface of the body 122, e.g., extends at least about half the thickness, $t_{Band}$, of the band body 122. The vertical element 522 defines a groove or trough (or female mating surface) 524 that extends into the material of the body 122 (e.g., one third to two thirds of the height of the vertical element 522). The joining mechanism 520 further includes as part of the inner sidewall 133 of the outer band element 130 a vertical element 526 that extends vertically from the planar outer surface of the body 132 (e.g., transverse to a plane passing through the body 132), and this vertical element 526 may define a trough or groove for receiving the vertical element or wall 522 of the middle band element 120. The vertical element 526 may extend vertically (e.g., "upward" in the figure) a distance of about one half to two thirds or more of the band thickness, $t_{Band}$, into the groove or trough 524 of the body 122.

To provide a secure or snapping fit, the vertical element 526 may include a tip, head, or zipper engagement member 528 that has a greater diameter than the adjacent vertical element 526 and that matches (or corresponds to) the size and shape of the receiving trough/groove 524. In this manner, the coupling of the band elements 120, 130 is provided when the tip 528 is snapped or zipped into the groove 524 such that the vertical element 526 typically will not unintentionally separate from the vertical element 522 (e.g., a user can unzip or peel away the layer or band element 130 but some predefined amount of force must be applied when such separation or decoupling is desired). In brief, one of the sidewalls or edges 128 is configured to provide a vertically arranged (i.e., transverse or even perpendicular to a plane extending through the band bodies 112, 122, 132) female coupler while the adjacent and mating edge or sidewall 133 is configured to provide an opposite vertically arranged, male coupler. Typically, the cross sectional shapes and dimensions of these coupling components 522, 524, 526, 528 correspond but some embodiments may provide some tolerances to account for manufacturing (e.g., have the tip 528 be smaller in diameter or width than the trough/groove 524) or may be selected to achieve more of an interference fit (e.g., have the tip 528 have a larger diameter or width than the groove 524).

Figure 6:
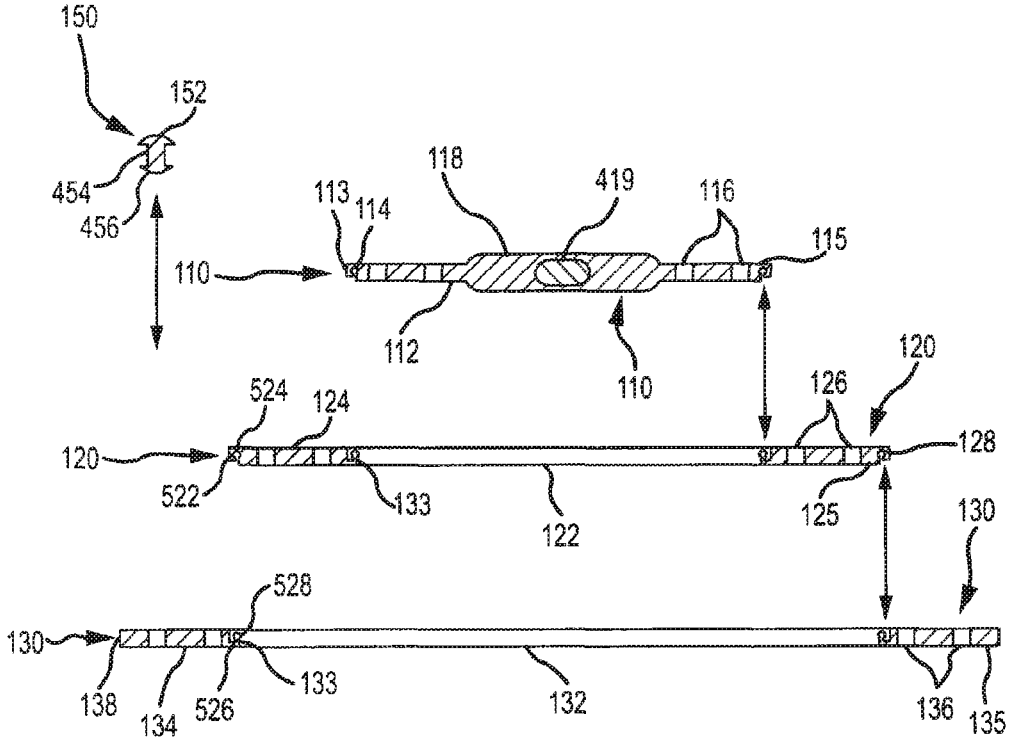
FIG. 6 is an exploded view of the band assembly of FIG. 4 showing how the three layers/elements may be interconnected or interchanged to provide a band of a desired length or size.

FIG. 6 provides an exploded view of the band assembly 100. As shown, inner band element or layer 110 may be thought of as the core of the assembly 100 as it is included in any configuration of the assembly 100 and provides the center portion upon which next layers are attached. The sidewall 113 of the inner body element 110 may have male or female coupling components (with female couplers or vertical grooves shown in FIG. 6) for receiving opposite coupling components of the middle or intermediary band element 120 (with this sidewall 123 shown to provide male couplers or vertical posts or zipper elements). The next ring of the concentric ring band assembly 100 is provided by the middle band element 120 with its body 122 including a gap or hole in its center for receiving the body 112 of inner band element 110 such that sidewall 113 abuts or mates with inner sidewall 123. The outer sidewall 128 includes vertically arranged a male or female coupling element (with a female coupler or wall 522 and groove 524 shown in FIG. 6).

Further, the next concentric ring of the assembly 100 is provided by outer band element 130 which includes a gap or hole in its body 132 that is sized and shaped to receive the middle band element 120 such that the inner sidewall 133 mates with or abuts outer sidewall 128 (e.g., tip/post 528 is received within groove or trough 524 when the band elements 120, 130 are snapped or zipped together about the periphery of sidewall 128). The Clasp 150 may be inserted into a hole in whichever band element 110, 120, 130 provides the outer most edge or end such as in band element 120 when the assembly 100 is configured to only include layers 110 and 120.

As will be understood by the above description of the assembly 100, the use of a number of concentric band elements or layers that can be selectively coupled together provides a desirable multi-sizing functionality that provides a "one size fits all" product (e.g., an RFID wristband or the like). For example, the assembly 100 may be shipped or provided to all end users with the three layers/band elements 110, 120, 130 assembled or coupled together. If the end user or wearer has a small wrist (part of the group or population with wrists smaller than some predefined boundary such as 125 mm), the end user may size their assembly 100 by removing band elements 120 and 130 and using just the core or inner band element 110 with clasp 150. If the end user or wearer has a mid-range wrist size or is "average" (e.g., falls within a middle group or size range for the intended user population), the end user may size their assembly 100 by removing the band element 130 and placing the clasp 150 into an end of the middle or intermediary band element 120 (or second ring of the concentric ring assembly 100). Finally, if the end user has a large wrist (e.g., a wrist size that falls within the group or portion of the population with relatively large wrists such as over about 190 mm or the like), the end user may use the band assembly 100 as it is received with all three band elements 110, 120, 130 and adjust the size by placing the clasp 150 in a particular hole in the opposite side (in any of the band elements 110, 120, 130 as the hole are aligned for such tightening of the band).

Such a design of band assembly 100 provides one common band that can be provided to a large population of users. This minimizes the number of products that have to be manufactured and limits the inventory required to service the population. For example, one or two (or more) base designs (e.g., colors, lengths, shapes, and so on) of the band assembly may be produced. Then, the end user can size the assembly to their wrist and also (optionally) customize the band assembly by replacing the base or original band elements with other ones (e.g., replace the middle or outer elements 120, 130 with user-selected or user-specific components) that may have art or graphic treatments desired by the end user but that maintains the base/core band element 110 with its intelligence component 118 (such as the RFID technology that may be programmed for the buyer/consumer).

Figure 7:
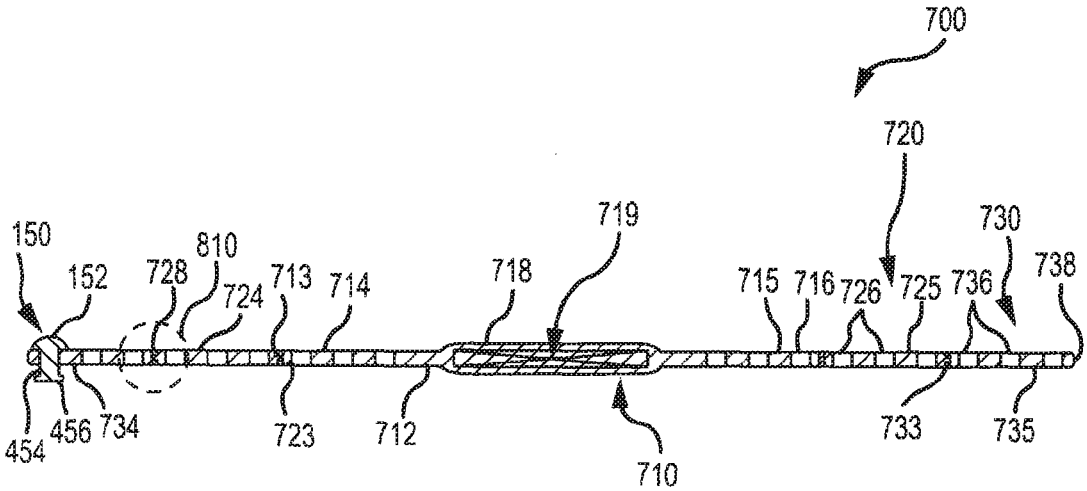
FIG. 7 illustrates a sectional view similar to that shown in FIG. 4 of a band assembly taken along line 7-7 and showing another coupling or interconnecting mechanism or assembly provided at the adjoining or mating edges of the band layers/elements to facilitate tool-less connection and removal of the layers/elements to provide a multi-sizing mechanism with the band assembly.

As mentioned above, the coupling or interconnecting mechanism may be implemented in a number of ways to allow the band elements or layers to be selectively joined together into a band assembly. FIGS. 7 and 8 illustrate another embodiment of a band assembly 700 that may be used to provide an alternative joining mechanism 820 (shown more clearly in enlarged view 810 of FIG. 8). The band assembly 700 is similar to assembly 100 in that it includes an inner or core band element 710 that may be increased in size by inclusion of a middle band element 720 and even further with an outer band element 730. The inner band element 710 includes a body 712 that may again be generally planar and rectangular with rounded end portions 714, 715 (which contain a number of holes 716 for mating with clasp 150 and its shaft 454 and tip/head 456). An intelligence or ID component 718 may be provided in the body such as for holding an RIFD chip 719 or the like. The outer sidewall or edge 713 extending about the periphery of the body 712 may be configured to provide a portion of the coupling mechanism 820, e.g., to provide a male or female portion of a horizontally arranged (e.g., generally in the plane of the body 712) tongue and groove mechanism 820 (with FIG. 7 showing the sidewall 713 providing the groove for receiving a post or tongue member on the inner sidewall 723 of the middle band element 720).

As with assembly 100, the band assembly 700 includes a middle band element or layer (or middle ring) 720 that has a body with a hole/gap for receiving the body 712 of element 710. In this manner, the inner sidewall 723 of the middle band member 720 abuts and engages with the outer sidewall 713 of the inner band element 710. The band element 720 may be generally rectangular in shape with rounded ends 724, 725 that include holes 726 for receiving the clasp 150 (or its post/shaft 454). The outer sidewall or edge 728 is adapted to provide a joining/coupling mechanism 820 when combined with the inner sidewall 733 of the outer band element 730 (e.g., to provide a groove or, as shown, a tongue/post that extends outward horizontally (or generally in the plane of the body of the element 720) outward some distance).

The band assembly 700 further includes a third/outer ring or band element 730 that may have a generally rectangular body with an outer shape defined by outer sidewall 738 and with a hole/gap for receiving the middle band element 720. In this position, the outer sidewall 728 of the middle band element 720 abuts and engages the inner sidewall 733 of the band element 730 (e.g., the tongue or, as shown, the groove in sidewall 733 mates with groove/tongue of sidewall 728). The outer band element 730 includes rounded ends 734, 735 with holes 736 for receiving clasp 150.

With reference to the enlarged view 810 in FIG. 8, the coupling or interlocking mechanism 820 is provided in assembly 700 to join band element 720 and band element 730 via their two sidewalls 728, 733. As shown, the outer sidewall 728 of the middle band element 720 includes a post or tongue 822 that extends horizontally (e.g., generally in the plane of the body of band element 720) outward from the edge 728 (e.g., a centrally located wall or tongue 822 that may have a rectangular or other cross sectional shape) about the periphery of the element 720. The inner sidewall 733 of the outer band element 730, in contrast, includes a groove or recessed surface 824 that is provided along the entire length of the wall 733.

In the locking mechanisms 520, 820, one or more additional design steps may be taken to facilitate more secure locking and/or reuse of the band elements (reassembly). For example, some embodiments may call for one of the mating components to be harder than the other. This may be implemented for example by having the female coupling element or groove be formed of a harder material or the same material but a higher durometer reading, e.g., the sidewall 733 with the groove 824 may be of a higher durometer than the sidewall 728 and/or the tongue/post 822 in coupling mechanism 820. In other embodiments, one or both of the mating components may have surfaces that increase friction such as by providing friction ridges on the post/tongue 822 and/or on the sidewalls of the groove 824 in the coupling mechanism 820. In other cases, a head or tip with a larger diameter may be provided on the end of the post/tongue 822 along with a larger sized receiving surface/trough at the end of the groove 824 to lock the band elements 720 and 730 (or 710 and 720) together.

Figures 9A, 9B, 9C:
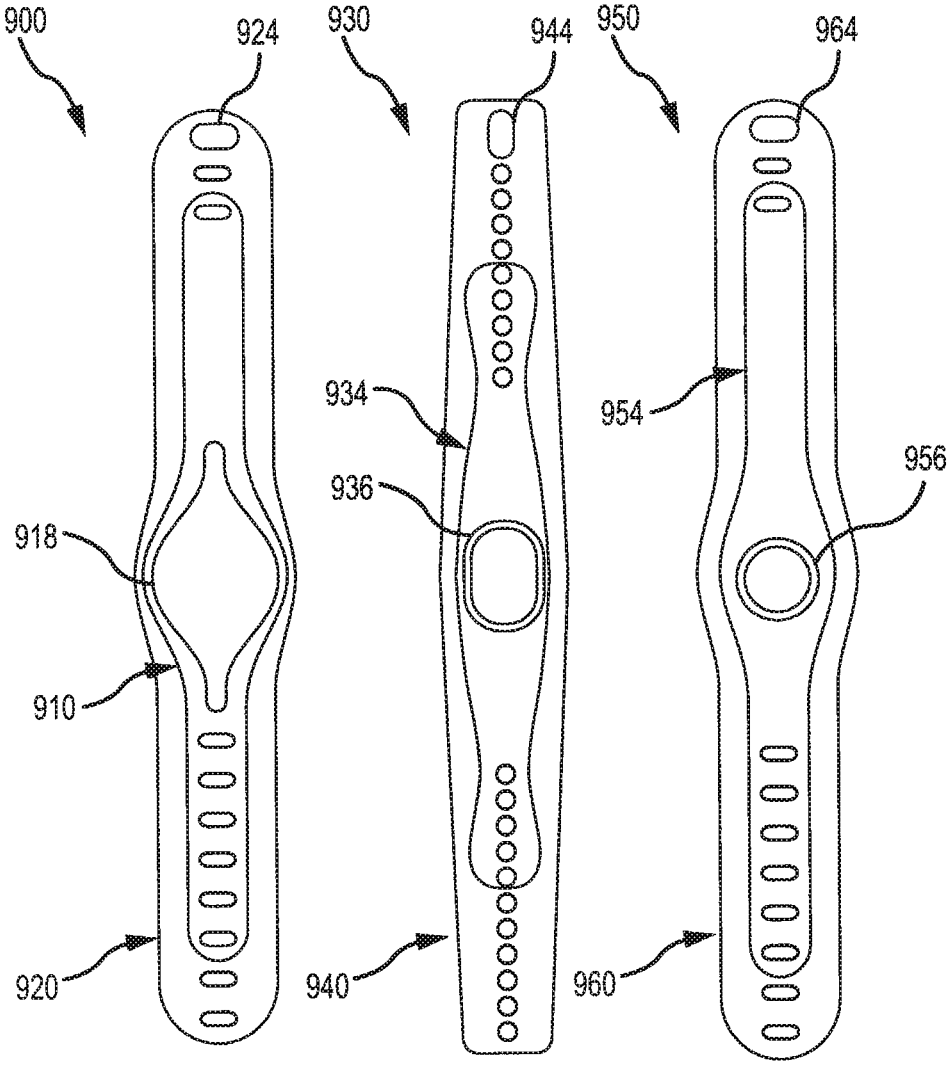
FIGS. 9A-9C show three additional embodiments of band assemblies that may utilize the interconnecting/coupling mechanisms of FIG. 6 or 8 to provide a two layer/element band assembly to provide two ranges of band sizes (and also illustrating with more examples how the layering technique may be used to provide numerous designs or aesthetics but with similar multi-sizing functionality).

The above described invention including the preferred embodiment and the best mode of the invention known to the inventor at the time of filing is given by illustrative examples only. It will be readily appreciated that many deviations may be made from the specific embodiments disclosed in the specification without departing from the spirit and scope of the invention. For example, FIGS. 9A to 9C illustrate additional band assemblies 900, 930, and 950 that implement the concentric band element or interchangeable layer concepts described above but with only two band elements. Specifically, the band assembly 900 includes a core or inner band element 910 with an intelligence member 918, and an outer band element 920 is coupled with the outer sidewall/edge of the inner band element 910 to increase its length (e.g., to allow it to cover two ranges of wrist sizes). The band element 920 may be removed and/or replaced with another band element or layer to customize or personalize the band assembly 900. A clasp 924 is provided to secure the assembly 900 onto a user's wrist. Likewise, band assemblies 930 and 950 include inner or core band elements 934, 954 with ID or intelligence members 936, 956 and further include outer rings or band elements 940, 960 with clasps 944, 964. The outer band elements 940, 960 may be coupled to the inner band elements 934, 954 to extend their lengths (and increase their widths), and these elements 940, 960 typically may be peeled away or removed and may be attached via coupling mechanisms (such as mechanisms 520, 820 or the like).

We claim:

1. A wearable band, comprising:

a first band element with a flexible planar body having a shape defined by an outer sidewall; and a second band element with a flexible planar body, wherein the second band element body comprises an inner sidewall extending about the first band element body and wherein the inner sidewall of the second band element body is detachably coupled to the outer sidewall of the first band element body;

wherein the first band element body comprises a plurality of linearly arranged and spaced apart holes in an end of the first band element body and wherein the second band element body comprises a plurality of linearly arranged and spaced apart holes in an end of the second band element body that is adjacent the end of the first band element body, whereby the holes of the first and second band element bodies are linearly aligned along a longitudinal axis.

2. The wearable band of claim 1, a clasp comprising at least one post extending outward from a surface of the first band element body at an end opposite the end of the first band element containing the holes for mating with at least one of the holes in the first or second band element bodies to couple two differing portions of the bodies.

3. The wearable band of claim 1, further comprising a third band element with a planar body, wherein the third band element body comprises an inner sidewall extending about the second band element body and wherein the inner sidewall of the third band element body is detachably coupled to an outer sidewall of the second band element body.

4. The wristband of claim 3, wherein the third band element body comprises a plurality of linearly arranged and spaced apart holes in an end of the third band element body that is adjacent the end of the second band element body, whereby the holes of the first, second, and third band element bodies are linearly aligned along the longitudinal axis.

5. A wearable band with an adjustable length, comprising:

a first band element with a body extending from a first to a second end and with an outer shape defined by an outer sidewall; and a second band element with a body extending from a first to a second end, the body of the second band element having a length greater than a length of the body of the first band element and having a hole defined by an inner sidewall for receiving the body of the first band element wherein the hole extends through a thickness of the body of the second band element, wherein the outer sidewall of the body of the first band element is mated with the inner sidewall of the body of the second band element such that the body of the second band element may be peeled away from the body of the first band element, wherein the first ends of the first and second band element bodies are arranged side-by-side, and wherein the first ends comprise a number of linearly arranged and spaced apart holes extending through the bodies of the first and second band elements.

6. The band of claim 5, wherein the bodies of the first and second band elements are substantially planar and wherein a coupling mechanism comprises a first coupling component extending along the outer sidewall of the first band element and a second coupling component extending along the inner sidewall, whereby the first and second band elements are connected along the entire periphery of the hole.

7. The band of claim 5, wherein a coupling mechanism comprises a tongue extending outward from the inner or outer sidewall and a groove adapted for receiving the tongue provided along the inner sidewall when the tongue is provided on the outer sidewall and along the outer sidewall when the tongue is provided on the inner sidewall.

8. The band of claim 7, wherein the body proximate to the tongue has a first hardness and the body proximate to the groove has a second hardness greater than the first hardness.

9. The band of claim 5, wherein a coupling mechanism comprises a vertical wall element spaced apart from the outer sidewall of the body of first band element and a vertical post element spaced apart from the inner sidewall of the body of the second band element, wherein the vertical wall element defines a groove for receiving the vertical post element including a head on the end of the vertical wall element.

10. The band of claim 5, further comprising:

a third band element with a body extending from a first to a second end, the body of the third band element having a length greater than the length of the second band element body and having a hole defined by an inner sidewall for receiving the second band element body;

a second coupling mechanism selectively connecting an outer sidewall of the second band element body and the inner sidewall of the third band element body; and a clasp for clasping a pair of the first and second ends of the bodies together, wherein the first and second ends of each of the bodies includes a number of holes for receiving a post of the clasp.

11. The band of claim 5, wherein the body of the first band element comprises a user identification member storing information corresponding to a wearer of the band.

12. The band of claim 11, wherein the user identification member comprises a radio frequency identification (RFID) tag.

13. The band of claim 5, further comprising a clasp with at least one post extending from a surface of the second end of the body of the first band element and adapted for mating with one of the holes in the bodies of the first and second band elements to couple the second end of the body of the first band element with the first end of the first band element or the first end of the second band element.

14. A wristband, comprising:

an inner band element comprising an elongated body with first closure elements located at distal ends of the elongated body; and an outer band element comprising an elongated body removably coupled to an edge of the elongated body of the inner band element wherein the body of the outer band element comprises a hole sized to receive the body of the inner band element and wherein the edge of the inner band element is mated to the body of the outer band element about the periphery of the hole, wherein the elongated body of the outer band element has second closure elements located on at least one distal end of the elongated body of the outer band element, and wherein the wristband is adapted to be closed using the first closure elements when the outer band element is removed from the inner band element and is adapted to be closed using the second closure elements when the outer band element is coupled to the edge of the elongated body of the inner band element.

15. The wristband of claim 14, wherein the first closure elements comprise a clasp including one or more posts extending from a surface of one of the distal ends of the body of the inner band element and further comprises two or more holes extending through the other one of the distal ends of the body of the inner band element.

16. The wristband of claim 15, wherein the second closure element comprise two or more holes extending through one of the distal ends of the body of the outer band element and adapted for mating with the one or more posts.

17. The wristband of claim 14, wherein the wristband has a first length equal to a length of the body of the outer band element when the outer band element is coupled to the body of the inner band element and has a second length less than the first length equal to a length of the body of the inner band element when the outer band element is removed.

* * * * *